US005485642A

United States Patent [19]

Wiggleton et al.

[11] Patent Number: 5,485,642

[45] Date of Patent: Jan. 23, 1996

[54] PURSE FILE WITH POP TOP OPENER

[76] Inventors: Patsy A. Wiggleton, 4718 Laura, Midland, Tex. 79703; George Spector, 233 Broadway Room 702, New York, N.Y. 10279

[21] Appl. No.: 406,122

[22] Filed: Mar. 17, 1995

[51] Int. Cl.[6] ..... B25F 1/00

[52] U.S. Cl. ..... 7/151

[58] Field of Search ..... 7/151, 162, 169; 81/3.55; 132/75.3, 75.6, 76.4

[56] References Cited

U.S. PATENT DOCUMENTS 805,486 11/1905 Rosenheimer ..... 7/151

1,268,930 6/1918 Cook ..... 7/162 X 4,884,307 12/1989 Flood ..... 7/162 X

*Primary Examiner*—D. S. Meislin

[57] ABSTRACT

A nail file and pop top opener comprising a nail file blade having abrasive surfaces on opposite sides for filing and trimming fingernails. A case has an open end to retain the nail file blade therein when not in use, so as to be carried in a purse. A sleeve has a slot therein to engage in a removable manner with one end of the nail file blade extending from the open end of the case. A pop top can opener is affixed to the sleeve. When the sleeve is in engagement with the one end of the nail file blade, the nail file blade is placed within the case. The pop top can opener could be maneuvered to lift up a pop top on a soft drink can, thereby preventing breakage of fingernails.

4 Claims, 1 Drawing Sheet

PURSE FILE WITH POP TOP OPENER

BACKGROUND OF THE INVENTION

The instant invention relates generally to hand tools and more specifically it relates to a nail file and pop top opener, which provides a nail file concealed in a case that is coupled to a pop top opener.

There are available various conventional hand tools which do not provide the novel improvements of the invention herein disclosed.

SUMMARY OF THE INVENTION

A primary object of the present invention is to provide a nail file and pop top opener that will overcome the shortcomings of the prior art devices.

Another object is to provide a nail file and pop top opener, in which a nail file blade that is concealed in a case is coupled in a removable manner to a pop top opener, so that it can be carried safety in a purse or on a key ring.

An additional object is to provide a nail file and pop top opener, in which the pop top opener will prevent the breaking of fingernails when opening a soft drink can, while the nail file when removed from the case is used for filing and trimming the fingernails.

A further object is to provide a nail file and pop top opener that is simple and easy to use.

A still further object is to provide a nail file and pop top opener that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
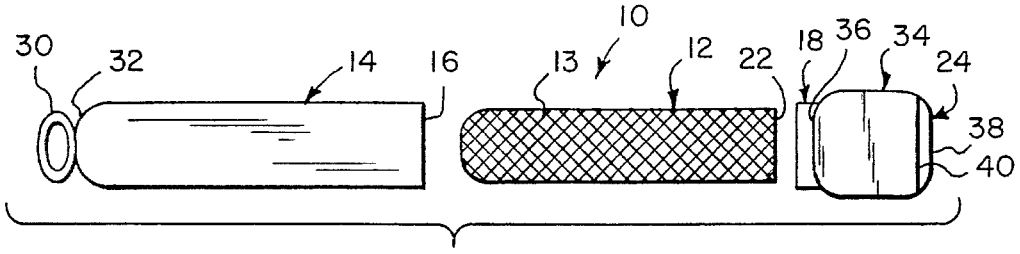
FIG. 1 is an exploded plan view of the instant invention.
Figure 2:
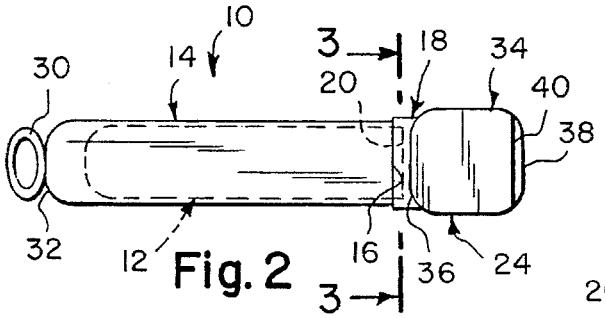
FIG. 2 is a plan view similar to FIG. 1 assembled.

Turning now descriptively to the drawings, in which similar reference characters denote similar elements throughout the several views, FIGS. 1 and 2 illustrate 1*a* nail file and pop top opener 10 comprising a nail file blade 12 having abrasive surfaces 13 on opposite sides, for filing and trimming fingernails. A case 14 has an open end 16 to retain the nail file blade 12 therein when not in use, so as to be carried in a purse. A sleeve 18 has a slot 20 therein, to engage in a removable manner with one end 22 of the nail file blade 12 extending from the open end 16 of the case 14. A pop top can opener 24 is affixed to the sleeve 18. When the sleeve 18 is in engagement with the one end 22 of the nail file blade 12 and the nail file blade 12 is placed within the case 14, the pop top can opener 24 could be maneuvered to lift up a pop top 26 on a soft drink can 28, thereby preventing breakage of fingernails, as shown in FIG. 4.

A ring 30 is attached to a closed end 32 of the case 14. The ring 30 can be placed on a key ring for easy access.

The pop top can opener 24 includes a head 34 having a first end 36 attached to the sleeve 18. A blade 38 extends from a second end 40 of the head 34. The blade 38 is used to engage with and lift up the pop top 26 on the soft drink can 28.

Figure 3:
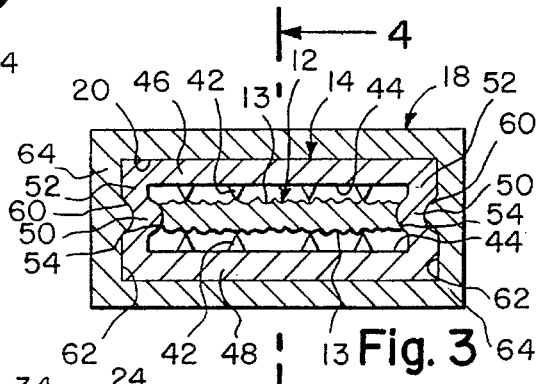
FIG. 3 is an enlarged cross sectional view taken along line 3—3 in FIG. 2, showing a modification for retaining an end of a nail file within a slot in a sleeve.
Figure 4:
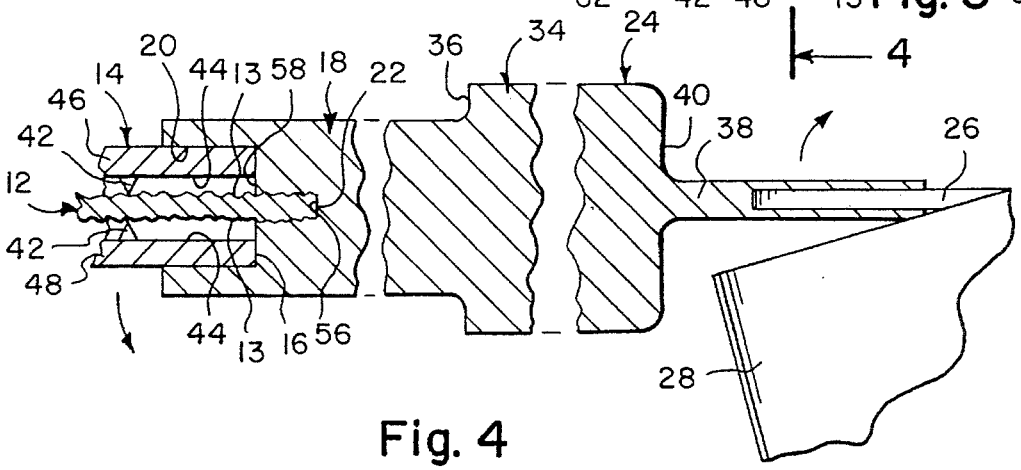
FIG. 4 is a cross sectional view taken along line 4—4 in FIG. 3 with parts broken away, showing a recess in the slot of the sleeve to receive the end of the nail file therein and a blade of a pop top can opener lifting a pop top up on a soft drink can.

FIGS. 3 and 4 show a modification, in which a plurality of projections 42 are formed on an inner surface 44 of a top wall 46 and a bottom wall 48 of the case 14, to engage with the abrasive surfaces 13 on said opposite sides of the nail file blade 12. A pair of compressible side clamps 50 are provided. Each compressible side clamp 50 is formed in one side wall 52 of the case 14, to engage with one edge 54 of the nail file blade 12. The sleeve 18 has a recess 56 in a back wall 58 in the slot 20, to receive the one end 22 of the nail file blade 12. The slot 20 is large enough to receive the open end 16 of the case 14 therein. A pair of protrusions 60 are provided. Each protrusion 60 is formed on an inner surface 62 of a side wall 64 in the slot 20 of the sleeve 18. When the open end 16 of the case 14 is inserted into the slot 20 of the sleeve 18, each protrusion 60 will press one compressible side clamp 50 in the sleeve 18 against one edge 54 of the nail file blade 12.

OPERATION OF THE INVENTION

To use the nail file blade 12 in the nail file and pop top opener 10, a person simply removes the case 14 from the nail file blade 12 to expose the abrasive surfaces 13, so as to file and trim the fingernails. To use the pop top opener 24, simply grasp the case 14 when placed over the nail file blade 12 and insert the blade 38 under the pop top 26 on the soft drink can 28 and press the case 14 downwardly to lift up the pop top 26.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A nail file and pop top opener comprising:

a) a nail file blade having abrasive surfaces on opposite sides for filing and trimming fingernails;

b) a case having an open end to retain said nail file blade therein when not in use, so as to be carried in a purse;

c) a sleeve having a slot therein to engage in a removable manner with one end of said nail file blade extending from said open end of said case; and d) a pop top can opener affixed to said sleeve, so that when said sleeve is in engagement with said one end of said nail file blade and said nail file blade is placed within said case, said pop top can opener could be maneuvered to lift up a pop top on a soft drink can thereby preventing breakage of fingernails.

2. A nail file and pop top opener as recited in claim 1, further including a ring attached to a closed end of said case, so that said ring can be placed on a key ring for easy access.

3. A nail file and pop top opener as recited in claim 2, wherein said pop top can opener includes:

a) a head having a first end attached to said sleeve; and b) a blade extending from a second end of said head, whereby said blade is used to engage with and lift up the pop top on the soft drink can.

4. A nail file and pop top opener as recited in claim 3, further including:

a) a plurality of projections formed on an inner surface of a top wall and a bottom wall of said case, to engage with said abrasive surfaces on said opposite sides of said nail file blade;

b) a pair of compressible side clamps, each said compressible side clamp formed in one side wall of said case to engage with one edge of said nail file blade;

c) said sleeve having a recess in a back wall in said slot to receive said one end of said nail file blade, while said slot is large enough to receive said open end of said case therein; and d) a pair of protrusions, each said protrusion formed on an inner surface of a side wall in said slot of said sleeve, so that when said open end of said case is inserted into said slot of said sleeve, each said protrusion will press one said compressible side clamp in said sleeve against one said edge of said nail file blade.

* * * * *